US008937433B1

(12) United States Patent
Wang et al.

(10) Patent No.: US 8,937,433 B1
(45) Date of Patent: Jan. 20, 2015

(54) LED LIGHTING SYSTEMS, LED CONTROLLERS AND LED CONTROL METHODS FOR A STRING OF LEDS

(71) Applicant: Analog Integrations Corporation, Hsin-Chu (TW)

(72) Inventors: Jing-Chyi Wang, Hsin-Chu (TW); Chang-Yu Wang, Hsin-Chu (TW); Wei-Ming Chen, Hsin-Chu (TW)

(73) Assignee: Analog Integrations Corporation, Science Park, Hsin-Chu (TW)

( * ) Notice: Subject to any disclaimer, the term of this patent is extended or adjusted under 35 U.S.C. 154(b) by 3 days.

(21) Appl. No.: 14/023,439

(22) Filed: Sep. 10, 2013

(51) Int. Cl.
*H05B 37/02* (2006.01)

(52) U.S. Cl.
USPC ..... 315/193; 315/122; 315/226; 315/291; 315/394; 315/308

(58) Field of Classification Search
USPC ..... 315/122, 185 R, 192, 193, 224, 226, 315/291, 294, 308, 312
See application file for complete search history.

(56) References Cited

U.S. PATENT DOCUMENTS

| | | | | |
|---|---|---|---|---|
| 2012/0081009 | A1* | 4/2012 | Shteynberg et al. | 315/122 |
| 2012/0217887 | A1* | 8/2012 | Kang et al. | 315/193 |
| 2012/0280622 | A1* | 11/2012 | Jeong et al. | 315/122 |
| 2013/0169175 | A1* | 7/2013 | Grajcar | 315/193 |

* cited by examiner

*Primary Examiner* — Douglas W Owens
*Assistant Examiner* — Thai Pham
(74) *Attorney, Agent, or Firm* — Winston Hsu; Scott Margo

(57) ABSTRACT

LED controllers, LED lighting systems and control methods capable of providing an average luminance intensity independent from the variation of an AC voltage. A string of LEDs are divided into LED groups electrically connected in series between a power source and a ground. A LED controller has path switches, each for coupling a corresponding LED group to the ground. A management center controls the path switches, for making an input current from the power source to the string substantially approach a target value. A line waveform sensor coupled to the power source holds a representative signal during a cycle time of the power source. The representative signal is in response to an attribute of the power source, and substantially determines the target value.

20 Claims, 8 Drawing Sheets

LED LIGHTING SYSTEMS, LED CONTROLLERS AND LED CONTROL METHODS FOR A STRING OF LEDS

BACKGROUND

The present disclosure relates generally to LED lighting systems and LED control methods therefor.

LED lights have several advantages. For example, LEDs have been developed to have lifespan up to 50,000 hours, about 50 times as long as a 60-watt incandescent bulb. Furthermore, an LED requires minute amount of electricity, having luminous efficacy about 10 times higher than an incandescent bulb and 2 times higher than a florescent light. As power consumption and conversion efficiency are big concerns in the art, LED lights are expected to replace several kinds of lighting fixtures in the long run.

A LED is a current-driven device. As commonly known in the art, the brightness of a LED is substantially determined by its driving current, and the voltage drop across the LED when illuminating, commonly referred to as forward voltage, is about a constant. FIG. 1 shows LED lighting system 20 according to US patent application publication 20120217887, which is incorporated herein by reference in its entirety. LED lighting system 20 in FIG. 1 has LED string 14 with LEDs $\mathbf{15}_a$, $\mathbf{15}_b$ and $\mathbf{15}_c$ connected in series. Bridge rectifier 12, connected to a branch circuit providing an alternative-current (AC) voltage $V_{AC}$, generates input voltage $V_{IN}$ as an input power source to power LED string 14. Switch controllers $C_a$, $C_b$, and $C_c$ control path switches $S_a$, $S_b$, and $S_c$, respectively, where each path switch is connected to a cathode of a LED. Mode decider 32 decides the operation modes of the operational amplifiers ($C_a$/$C_b$, and $C_c$), in response to current sense voltages $VCS_a$, $VCS_b$, and $VCS_c$. Line waveform sensor 28 determines current-setting voltage $V_{SET}$ based on the present input voltage $V_{IN}$, while current-setting voltage $V_{SET}$ substantially determines the target value of the current passing a LED in the LED string when that LED shines.

FIGS. 2A and 2B demonstrate two different luminance intensity results when LED lighting system 20 is powered by branch circuits of 200 ACV and 100 ACV, respectively, where threshold voltages $V_{TH1}$, $V_{TH2}$ and $V_{TH3}$ are the forward voltages of the LED string with only LED $\mathbf{15}_a$, the LED string with LEDs $\mathbf{15}_a$ and $\mathbf{15}_b$, and the LED string with LEDs $\mathbf{15}_a$, $\mathbf{15}_b$ and $\mathbf{15}_c$, respectively. FIGS. 3A and 3B demonstrate the input current $I_{IN}$ from input voltage $V_{IN}$ to the LED string 14 of FIG. 1 when LED lighting system 20 is powered by branch circuits of 200 ACV and 100 ACV, respectively. Input current $I_{IN}$ in FIG. 3B is almost a constant when the LED string 14 is driven to illuminate. Recess 26 in FIG. 3A, which causes the happening of recess 24 in FIG. 2A, occurs, nevertheless, because there is a period of time when input voltage $V_{IN}$ exceeds reference voltage $V_{IN\text{-}REF}$. Recess 24 helps the shadowed area in FIG. 2A to be as large as that in FIG. 2B, such that the average luminance intensity of the LED lighting system 20 could be independent to the voltage magnitude of the branch circuit.

BRIEF DESCRIPTION OF THE DRAWINGS

The invention can be more fully understood by the subsequent detailed description and examples with references made to the accompanying drawings, wherein.

DETAILED DESCRIPTION

The following embodiments are described in sufficient detail to enable those skilled in the art to make and use the invention. It is to be understood that other embodiments would be evident based on the present disclosure, and that improves or mechanical changes may be made without departing from the scope of the present invention.

In the following description, numerous specific details are given to provide a thorough understanding of the invention. However, it will be apparent that the invention may be practiced without these specific details. In order to avoid obscuring the present invention, some well-known configurations and process steps are not disclosed in detail.

Figure 3A:
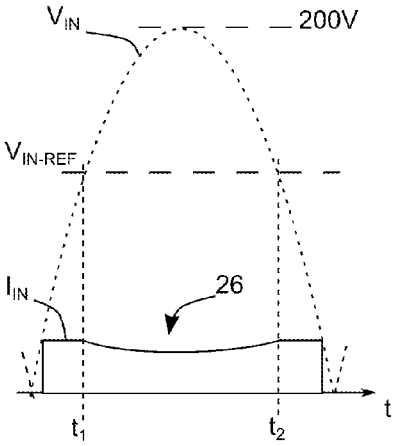
FIG. 3A (PRIOR ART)
FIGS. 3A and 3B demonstrate the input current $I_{IN}$ from input voltage $V_{IN}$ to the LED string of FIG. 1 when the LED lighting system is powered by branch circuits of 200 ACV and 100 ACV, respectively.
Figure 3B:
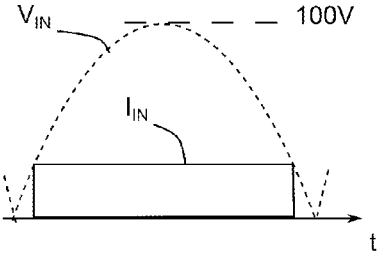
FIG. 3B (PRIOR ART)

Even though recess 26 in FIG. 3A provides constant brightness control to LED lighting system 20, it deteriorates power factor (PF) and electromagnetic interference (EMI) of LED lighting system 20, however. An excellent power factor requires an input current to an electronic appliance substantially in phase with an input voltage supplied. At the time when recess 26 happens, the input current $I_{IN}$ is adversely about out of phase with the input voltage $V_{IN}$, because the higher input voltage $V_{IN}$ the lower input current $I_{IN}$. It could be derived that the power factor exhibited in FIG. 3A is worse than that exhibited in FIG. 3B. Furthermore, in comparison with the waveform of input current $I_{IN}$ in FIG. 3B, recess 26 in FIG. 3A introduces two additional corners at about the time points of $t_1$ and $t_2$, which distribute more energy to radiation signals in view of frequency spectrum, resulting worse EMI.

In one embodiment of the invention, the peak voltage $V_{IN\text{-}PEAK}$ of input voltage $V_{IN}$ is sensed and a representative voltage $V_{PSTV}$ is accordingly provided to represent the peak voltage $V_{IN\text{-}PEAK}$. This representative voltage $V_{PSTV}$ is held, by a capacitor for example, substantially unchanged when any one of the LEDs in a LED string shines. In another point of view, the representative voltage $V_{PSTV}$ is about the same during the cycle time of the input voltage $V_{IN}$, where the input voltage $V_{IN}$ might be, for example, 220V or 110V of magnitude, and 120 Hz or 110 Hz of frequency. The representative voltage $V_{PSTV}$ determines the target value to which the driving current flowing through an illuminating LED is controlled to approach. The higher the representative voltage $V_{PSTV}$, the lesser the driving current and the darker the illuminating LED. As will be detailed later, the dependence of the driving current to the representative voltage $V_{PSTV}$ according to one embodiment of the invention could also provide substantially-constant average luminance intensity control.

Different from the driving current in FIG. 3A, which varies in a cycle time in response to the present magnitude of input voltage $V_{IN}$ and forms the recess 26, the driving current in one embodiment of the invention is about a constant in one cycle time, such that the recess 26 occurs no more, resulting in well-controlled power factor and EMI.

In one embodiment, although the representative voltage $V_{PSTV}$ is about a constant in one cycle time, it is slightly reduced when the input voltage $V_{IN}$ is at about a valley, in order to track the peak voltage $V_{IN\text{-}PEAK}$ which might go down in a following cycle time. The timing when the representative voltage $V_{PSTV}$ slightly reduces could be at the moment when a most upstream LED is switched OFF due to a too-low input voltage $V_{IN}$.

Some embodiment detects directly the peak voltage $V_{IN\text{-}PEAK}$ by using a resistor connected to the input voltage $V_{IN}$. Other embodiment detects the peak voltage $V_{IN\text{-}PEAK}$ indirectly by using a resistor connected to a cathode of an LED in a LED string. In some other embodiments, the resistor could be replaced by a capacitor to sense a maximum differentiation value of the input voltage $V_{IN}$, which in a way represents the peak voltage $V_{IN\text{-}PEAK}$ too.

Figure 1:
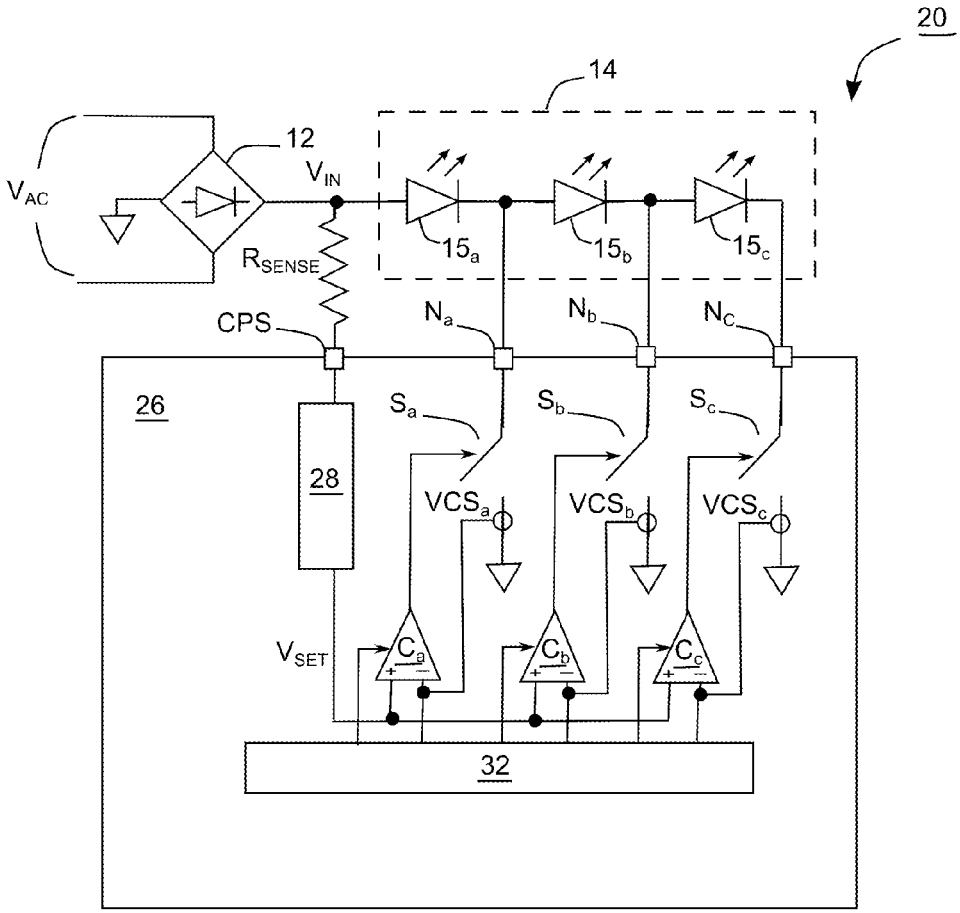
FIG. 1 (PRIOR ART)
FIG. 1 shows a LED lighting system in the art.
Figure 4:
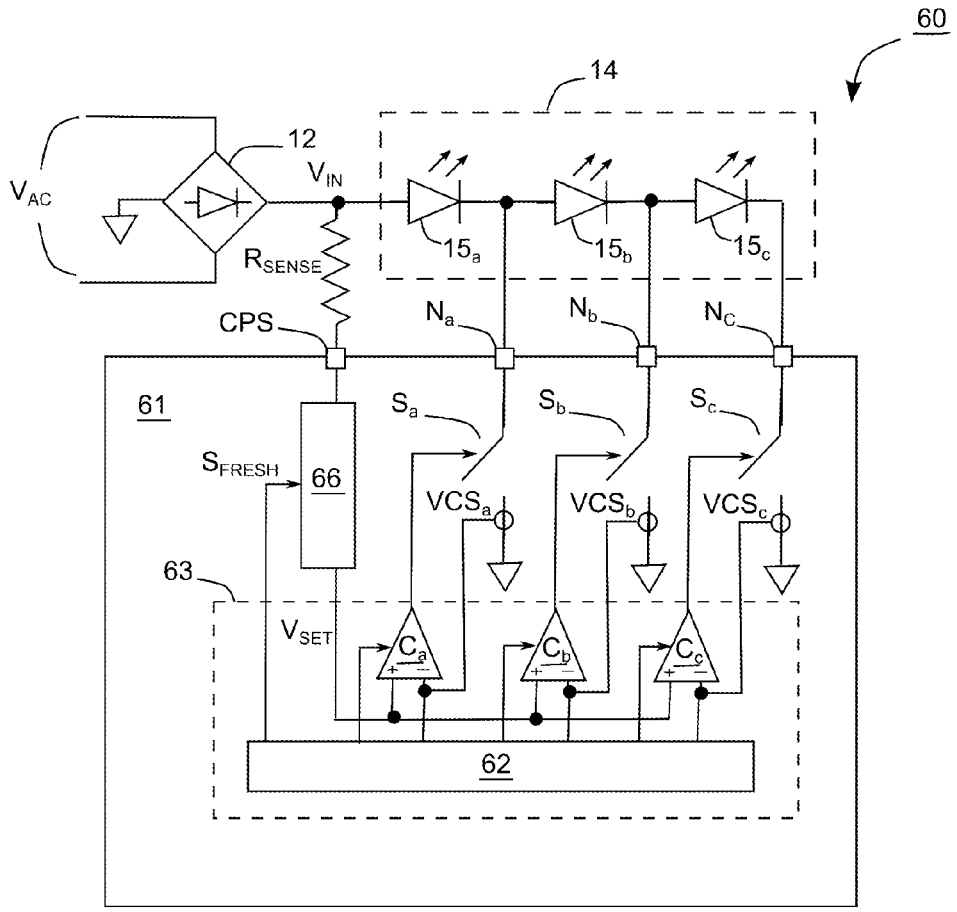
FIG. 4 shows a LED lighting system 60 according to embodiments of the invention.

FIG. 4 shows a LED lighting system 60 according to embodiments of the invention. Similar with LED lighting system 20 in FIG. 1, LED lighting system 60 in FIG. 4 has LED string 14 with LEDs $\mathbf{15}_a$, $\mathbf{15}_b$ and $\mathbf{15}_c$ connected in series. Each LED in LED string 14 represents a LED group, which in one embodiment includes only one micro LED, and in some other embodiments includes several micro LEDs connected in series or in parallel. In one non-limiting embodiment, each LED has the same number of micro LEDs connected in series. In one embodiment, the micro LEDs in the LED string 14 are of the same color, which is red, green, blue, or white, for example. Nevertheless, some embodiments have the LED string 14 consisting of different-color micro LEDs. The LED string according to the invention is not limited to have only 3 LEDs, and could have any number of LEDs in other embodiments.

Bridge rectifier 12, connected to a branch circuit providing an AC voltage $V_{AC}$, generates input voltage $V_{IN}$ as an input power source to power LED string 14. The AC voltage $V_{AC}$ could be of 100 VAC, 110 VAC, 220 VAC, or 230 VAC with a frequency of 50 Hz or 60 Hz. As a result, input voltage $V_{IN}$ could be of an M-shaped waveform with a frequency of 100 Hz or 120 Hz.

LED controller 61 could be embodied in an integration circuit with several pins. In one embodiment, one pin of LED controller 61, referred to as pin CPS, is directly connected to input voltage $V_{IN}$ by resistor $R_{SENSE}$ to sense the waveform of input voltage $V_{IN}$. Pins $N_a$, $N_b$, $N_c$ are respectively connected to the cathodes of LEDs $\mathbf{15}_a$, $\mathbf{15}_b$ and $\mathbf{15}_c$, providing separate conduction paths to drain current to ground. Inside LED controller 61 are path switches $S_a$, $S_b$, and $S_c$, line waveform sensor 66 and management center 63.

Path switches $S_a$, $S_b$, and $S_c$ respectively control conduction paths from pins $N_a$, $N_b$, $N_c$, to the ground, and are controlled by management center 63, which includes switch controllers $C_a$, $C_b$, $C_c$ and mode decider 62. The control circuit for one path switch is similar with the one for another. Taking the control for path switch $S_a$ as an example, switch controller $C_a$, which is an operational amplifier in this embodiment, could operate in one of several modes, including but not limited to fully-ON, fully-OFF, and constant-current modes, depending upon the signal sent from mode decider 62. For example, when switch controller $C_a$ is determined to operate in the constant-current mode, switch controller $C_a$ controls the impedance of path switch $S_a$ to make current sense voltage $VCS_a$ approach current-setting voltage $V_{SET}$. Current sense voltage $VCS_a$ is the detection result representing the current passing path switch $S_a$. When switch controller $C_a$ is determined to operate in the fully-ON mode, path switch $S_a$ is always ON, performing a short circuit, disregarding current sense voltage $VCS_a$. On the other hand, when switch controller $C_a$ is determined to operate in the fully-OFF mode, path switch $S_a$ is always OFF, performing an open circuit, disregarding current sense voltage $VCS_a$. In one instant when input voltage $V_{IN}$ is high enough to turn on the LED string with only LEDs $\mathbf{15}_a$ and $\mathbf{15}_b$, for example, switch controllers $C_a$, $C_b$ and $C_c$ could operate in the fully-OFF, constant-current and fully-ON modes, respectively, such that the current passing through LEDs $\mathbf{15}_a$ and $\mathbf{15}_b$ are the same, corresponding to current-setting voltage $V_{SET}$, and that current passing through LED $\mathbf{15}_c$ is about zero. If later on input voltage $V_{IN}$ ramps down and mode decider 62 finds current sense voltage $VCS_b$ cannot increase to approach current-setting voltage $V_{SET}$, then mode decider 62 changes the operation modes of switch controllers $C_a$ and $C_b$ to be constant-current and fully-ON modes, respectively. Therefore, the current passing through LED $\mathbf{15}_a$ stays at a value determined by current-setting voltage $V_{SET}$, and those passing through LEDs $\mathbf{15}_b$ and $\mathbf{15}_b$ are zero. In the opposite, if later on input voltage $V_{IN}$ ramps up and current sense voltage $VCS_c$ indicates that the current passing through LED $\mathbf{15}_c$ turns to be more than zero, switch controllers $C_b$ and $C_c$ are switched to operate in the fully-OFF and constant-current modes, respectively. From the teaching above, it can be concluded that current-setting voltage $V_{SET}$ substantially determines the target value of the current passing a LED in the LED string when that LED shines.

In one embodiment, line waveform sensor 66 detects the waveform of input voltage $V_{IN}$ via resistor $R_{SENSE}$, and accordingly provides current-setting voltage $V_{SET}$. Line waveform sensor 66, for example, holds a representative voltage $V_{PSTV}$ representing the peak voltage $V_{IN\text{-}PEAK}$ of the input voltage $V_{IN}$. The operational amplifier turns on an NMOS in line waveform sensor 66 to raise the representative voltage $V_{PSTV}$ if the representative voltage $V_{PSTV}$ is less than a divided voltage of the input voltage $V_{IN}$ at pin CPS, such that representative voltage $V_{PSTV}$ represents the peak voltage $V_{IN\text{-}PEAK}$. The representative voltage $V_{PSTV}$ substantially stays unchanged during a cycle time of the input voltage $V_{IN}$, and determines current-setting voltage $V_{SET}$ and the current passing a LED as well. For instance, in case that the AC voltage $V_{AC}$ is 220 VAC, the representative voltage $V_{PSTV}$ corresponds to 220V. In case that the AC voltage is 110 VAC, the representative voltage $V_{PSTV}$ corresponds to 110V.

Figure 2A:
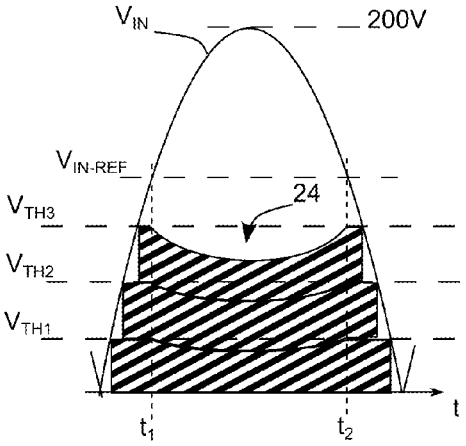
FIG. 2A (PRIOR ART)
FIGS. 2A and 2B demonstrate two different luminance intensity results when the LED lighting system of FIG. 1 is powered by branch circuits of 200 ACV and 100 ACV, respectively.
Figure 2B:
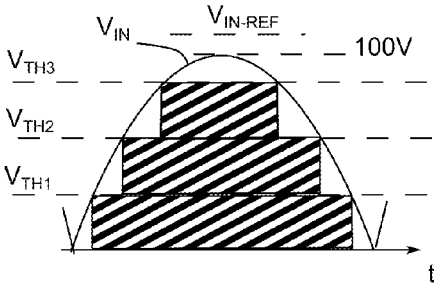
FIG. 2B (PRIOR ART)
Figure 5A:
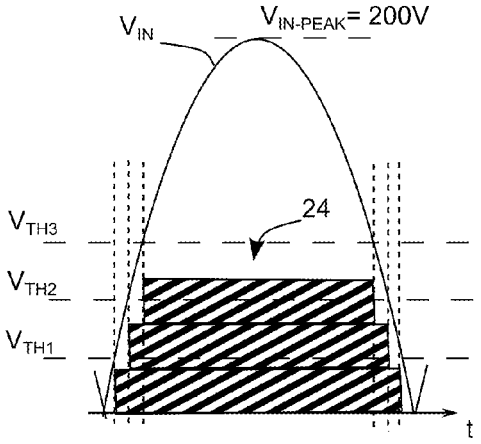
FIGS. 5A and 5B demonstrate two different luminance intensity results when the LED lighting system of FIG. 4 is powered by branch circuits of 200 ACV and 100 ACV, respectively.
Figure 5B:
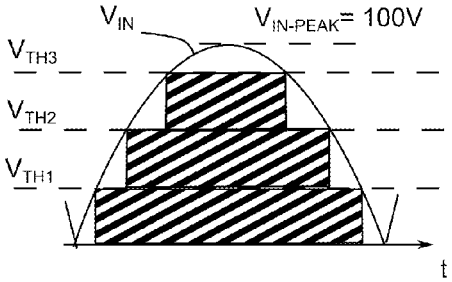
Figure 6A:
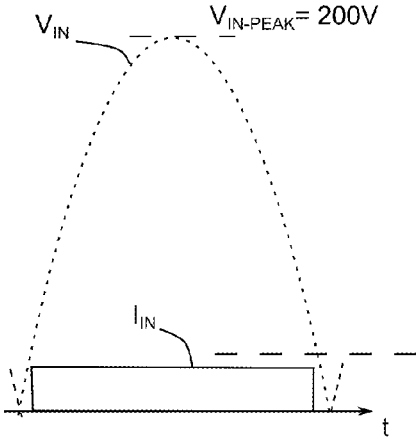
FIGS. 6A and 6B demonstrate the input current $I_{IN}$ from input voltage $V_{IN}$ to the LED string of FIG. 4 when LED lighting system is powered by branch circuits of 200 ACV and 100 ACV, respectively.
Figure 6B:
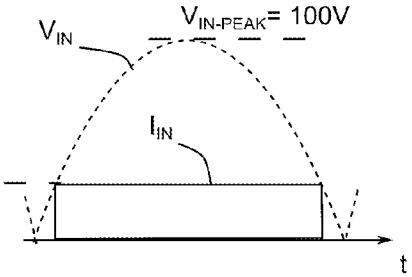

The representative voltage $V_{PSTV}$ substantially determines the current-setting voltage $V_{SET}$ provided. In one embodiment, if the peak voltage $V_{IN\text{-}PEAK}$ of the input voltage $V_{IN}$ is below a threshold value $V_{FOLD}$, the current-setting voltage $V_{SET}$ is a constant. If the peak voltage $V_{IN-PEAK}$ exceeds the threshold value $V_{FOLD}$, the higher the peak voltage $V_{IN-PEAK}$, the lower the current-setting voltage $V_{SET}$. FIGS. 5A and 5B demonstrate two different luminance intensity results when LED lighting system 60 is powered by branch circuits of 200 ACV and 100 ACV, respectively, where threshold voltages $V_{TH1}$, $V_{TH2}$ and $V_{TH3}$ are the forward voltages of the LED string with only LED $\mathbf{15}_a$, the LED string with LEDs $\mathbf{15}_a$ and $\mathbf{15}_b$, and the LED string with LEDs $\mathbf{15}_a$, $\mathbf{15}_b$ and $\mathbf{15}_c$, respectively. FIGS. 6A and 6B demonstrate the input current $I_{IN}$ from input voltage $V_{IN}$ to the LED string 14 of FIG. 4 when LED lighting system 60 is powered by branch circuits of 200 ACV and 100 ACV, respectively. FIGS. 5B and 6B are similar with FIGS. 2B and 3B, respectively, such that their explanation is omitted for brevity. Different with the waveforms in FIGS. 2A and 3A, those of FIGS. 5A and 5B have no recesses. Please note that when at least one LED is ON the input current $I_{IN}$ in FIG. 6A is smaller than that in FIG. 6B, because the peak voltage $V_{in-PEAK}$ in FIG. 5A is 200 ACV, higher than that in FIG. 5B. The instant luminance intensity of FIG. 5A is less than that of FIG. 5B simply because the input current $I_{IN}$ of FIG. 6A is less than that of FIG. 6B. The shadowed areas in FIGS. 5A and 5B represent two average luminance intensities that human eyes could conceive when the LED string 14 is powered by 200 VAC and 100 VAC, respectively. In comparison with that in FIG. 5B, the shadowed area in FIG. 5A is lower but wider, and could have the same in volume if fine-tuned. In other words, it is possible for the average luminance intensity of the LED lighting system 60 to be substantially independent to the voltage magnitude of the branch circuit.

Unlike the waveform of FIG. 3A, which has a recess and two additional corners, the waveform of FIG. 6A has neither the recess nor the two additional corners, implying better PF and EMI results.

Figure 7:
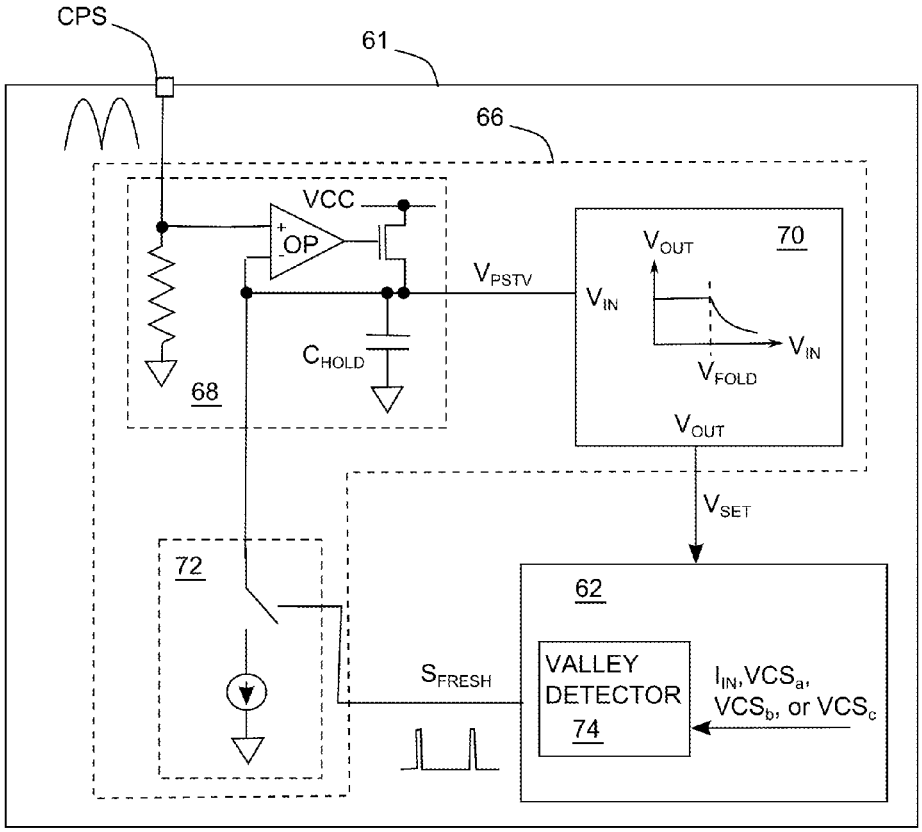
FIG. 7 illustrates some circuits in the line waveform sensor and the mode decider of FIG. 4 according to one embodiment of the invention.

FIG. 7 illustrates some circuits in line waveform sensor 66 and mode decider 62 of FIG. 4 according to one embodiment of the invention.

Shown in FIG. 7, line waveform sensor 66 has peak-hold circuit 68, transferring circuit 70 and refreshing circuit 72, while mode decider 62 has valley detector 74. Peak-hold circuit 68 can generate and hold representative voltage $V_{PSTV}$ over capacitor $C_{HOLD}$, to represent peak voltage $V_{PEAK-in}$ of input voltage $V_{IN}$. Transferring circuit 70 provides current-setting voltage $V_{SET}$ in response to representative voltage $V_{PSTV}$, based upon a predetermined transferring function. In the non-limiting embodiment shown in FIG. 7, the transferring function defines that current-setting voltage $V_{SET}$ is about a constant if representative voltage $V_{PSTV}$ is below a threshold value $V_{FOLD}$, and that the more the representative voltage $V_{PSTV}$ exceeds the threshold value $V_{FOLD}$ the less the current-setting voltage $V_{SET}$ is. Since representative voltage $V_{PSTV}$ and current-setting voltage $V_{SET}$ correspond to the peak voltage $V_{IN-PEAK}$ and the target value of input current $I_{IN}$, respectively, the target value of input current $I_{IN}$ is about a constant when the peak voltage $V_{IN-PEAK}$ is below a predetermined threshold, but decreases when the peak voltage $V_{IN-PEAK}$ exceeds the predetermined threshold.

The peak voltage $V_{IN-PEAK}$ of the input voltage $V_{IN}$ in a flowing cycle time might be different to that in the present cycle, and to track the change in the peak voltage $V_{IN-PEAK}$ of the input voltage $V_{IN}$, the representative voltage $V_{PSTV}$ might be refreshed once every cycle or every several cycles. It is a good timing to perform the refreshing when the input voltage $V_{IN}$ is so low that none LED in the LED string 14 shines, or when the input voltage $V_{IN}$ is about at a valley. In one embodiment, valley detector 74 in mode decider 62 generates a pulse $S_{FRESH}$ at the moment when input voltage $V_{IN}$ enters a valley. Upon receiving the pulse $S_{FRESH}$, refreshing circuit 72 refreshes the representative voltage $V_{PSTV}$.

In one embodiment, when none of current sense voltages $VCS_a$, $VCS_b$, and $VCS_c$ can be manipulated to be as high as current-setting voltage $V_{SET}$, valley detector 74 deems it as the occurrence of the input voltage $V_{IN}$ having entered a valley. When at least one of current sense voltages $VCS_a$, $VCS_b$, and $VCS_c$ is about the same as the current-setting voltage $V_{SET}$, the input voltage $V_{IN}$ exits the valley. In another embodiment, valley detector 74 could use other means to determine whether input voltage $V_{IN}$ enters or exits a valley. Normally, input voltage $V_{IN}$ enters and exits a valley once every cycle, and the signal $S_{FRESH}$ could, but is not limited to, be provided once whenever the input voltage $V_{IN}$ enters or exits a valley. The signal $S_{FRESH}$ could be provided once when every two valleys have be passed, for example.

In the embodiment shown in FIG. 7, the pulse $S_{FRESH}$ triggers a constant current source to discharge the capacitor $C_{HOLD}$ for a very short period of time, such that the representative voltage $V_{PSTV}$ is slightly reduced upon the receiving of the pulse $S_{FRESH}$.

Figure 8:
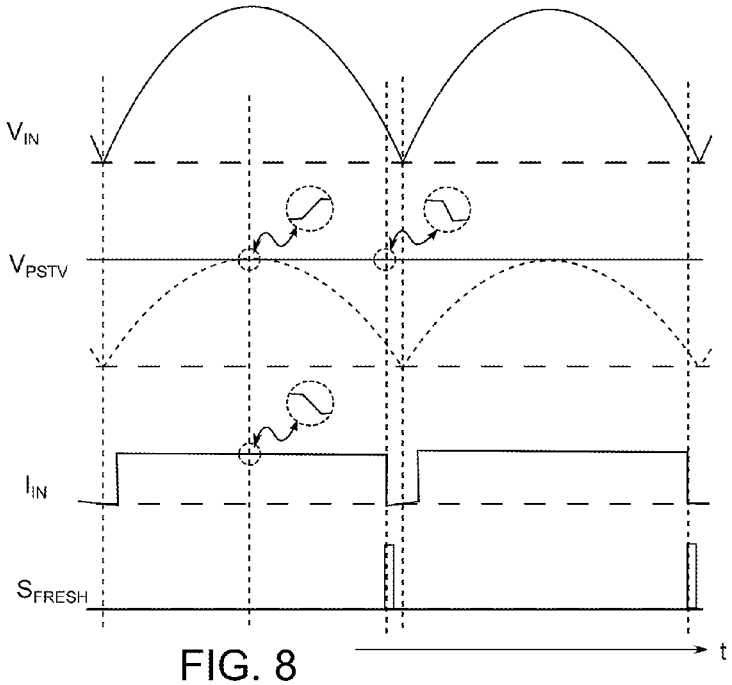
FIG. 8 demonstrates some signal waveforms relevant to FIGS. 4 and 7.

According to one embodiment of the invention, FIG. 8 demonstrates some signal waveforms relevant to FIGS. 4 and 7. Input voltage $V_{IN}$, as being a power source rectified from a sinusoidal AC voltage, has a M-shaped waveform as shown at the top of FIG. 8. Representative voltage $V_{PSTV}$ is about a constant all the time, but tracks the increment of input voltage $V_{IN}$ at about the middle of a cycle time. Accordingly, representative voltage $V_{PSTV}$ represents the peak voltage $V_{IN-PEAK}$. Input current $I_{IN}$, even though being about constant when any one LED of LED string 14 shines, reduces slightly at about the middle of a cycle time in response to the slight increment in representative voltage VPSTV. In FIG. 8, the pulse $S_{FRESH}$ is generated once every time when input current $I_{IN}$ drops to about zero, causing slight reduction to representative voltage $V_{PSTV}$. In other words, at the moment when management center 63 turns off the most upstream LED $\mathbf{15}_a$, representative voltage $V_{PSTV}$ is refreshed.

Figure 9:
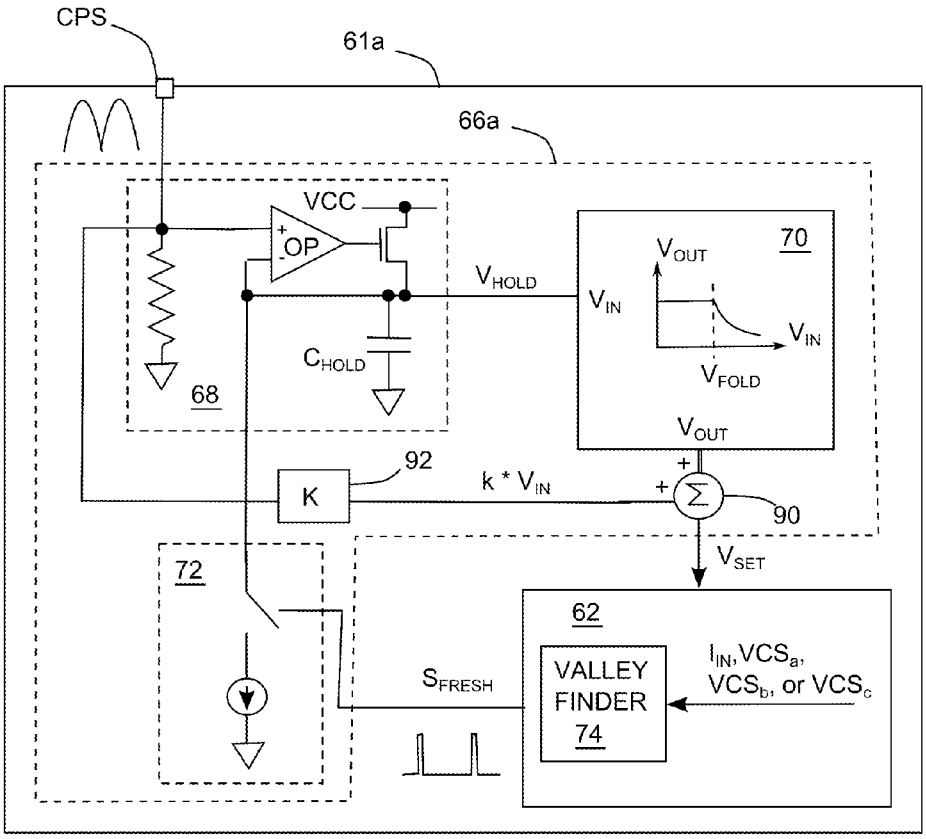
FIG. 9 illustrates a LED controller, which in another embodiment of the invention could embody the LED controller in FIG. 4.
Figure 10A:
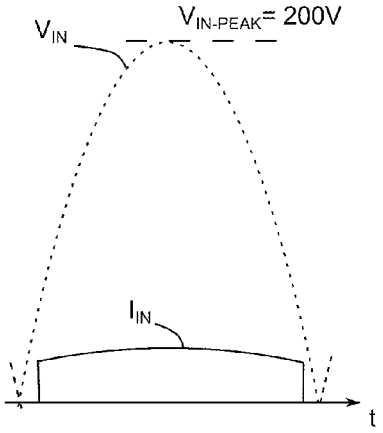
FIGS. 10A and 10B demonstrate the input current $I_{IN}$ from input voltage $V_{IN}$ to the LED string 14 of FIG. 4 when LED lighting system 60 employs the circuits in FIG. 9 and is powered by branch circuits of 200 ACV and 100 ACV, respectively.
Figure 10B:
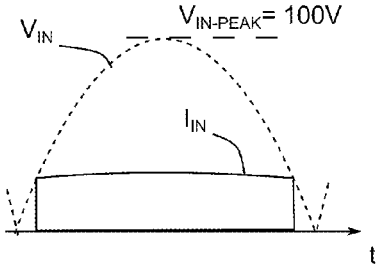

FIG. 9 illustrates a LED controller 61*a*, which in another embodiment of the invention could embody the LED controller 61 in FIG. 4. Comparison with FIG. 7, FIG. 9 additionally has adder 90 and attenuator 92. $kV_{IN}$, outputted by attenuator 92 and being in proportion to input voltage $V_{IN}$, is a small factor to slightly increase the current-setting voltage $V_{SET}$. FIGS. 10A and 10B demonstrate the input current $I_{IN}$ from input voltage $V_{IN}$ to the LED string 14 of FIG. 4 when LED lighting system 60 employs the circuits in FIG. 9 and is powered by branch circuits of 200 ACV and 100 ACV, respectively. FIGS. 10A and 10B could achieve less total harmonic distortion (THD), having less radioactive signal generated to other electric devices via the branch circuit.

Figure 11:
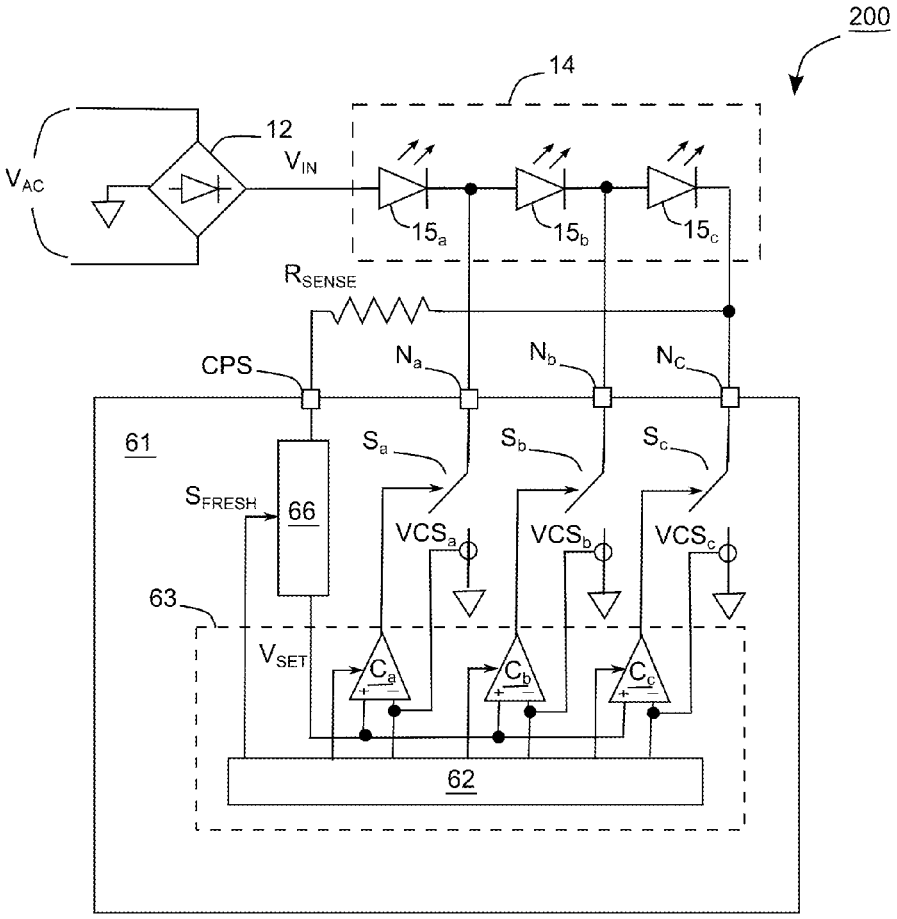
FIGS. 11 and 12 show two exemplary LED lighting systems.

The foregoing embodiments of the invention have resistor $R_{SENSE}$ coupled between pin CPS and bridge rectifier 12 to directly sense the waveform of input voltage $V_{IN}$. The invention is not limited thereto, however. Pin CPS could be coupled to any connection nodes in driven LED string 14 of FIG. 4, for example, to indirectly sense the waveform of input voltage $V_{IN}$. FIG. 11 shows an exemplary LED lighting system 200, which is the same with the LED lighting system of FIG. 4 but has resistor $R_{SENSE}$ coupled to pin $N_c$, the cathode of LEDs $\mathbf{15}_c$. In other embodiments, resistor $R_{SENSE}$ could be coupled from pin CPS to pin $N_b$ or pin $N_a$, instead.

Figure 12:
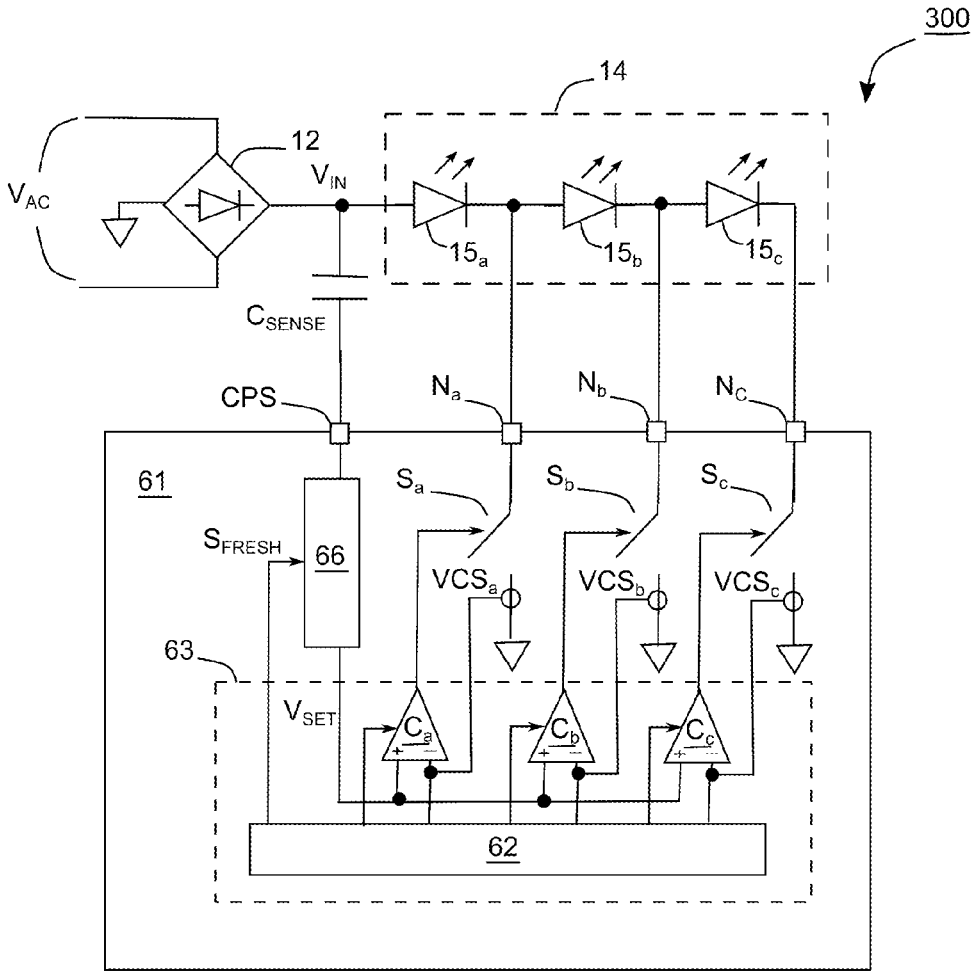

Line waveform sensors according to embodiments of the invention are not limited to sense the voltage at pin CPS to determine the peak voltage $V_{IN-PEAK}$ of input voltage $V_{IN}$. In some embodiments, it is the current flowing through resistor $R_{SENSE}$ and into pin CPS that a line waveform sensor senses to determine the peak voltage $V_{IN\text{-}PEAK}$ of input voltage $V_{IN}$. In other embodiment, it is the differentiation of input voltage $V_{IN}$ that a line waveform sensor senses to determine the peak voltage $V_{IN\text{-}PEAK}$. FIG. 12 shows an exemplary LED lighting system 300, which is the same with the LED lighting system of FIG. 4 but has resistor $R_{SENSE}$ replaced by capacitor $C_{SENSE}$. The differentiation of input voltage $V_{IN}$ could induce a current into pin CPS. The larger the maximum differentiation of input voltage $V_{IN}$, the larger the magnitude of input voltage $V_{IN}$, the higher the peak voltage $V_{IN\text{-}PEAK}$. In other embodiments, capacitor $C_{SENSE}$ could be connected between pin CPS and any one of pins $N_a$, $N_b$, and $N_c$.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A LED controller, suitable for controlling a string of LEDs, wherein the LEDs are divided into LED groups electrically connected in series between a power source and a ground, the LED controller comprising:

path switches, each for coupling a corresponding LED group to the ground;

a management center for controlling the path switches to conduct a driving current flow through at least one selected LED group of the LED groups, wherein the driving current is substantially about a target value; and a line waveform sensor coupled to the power source, for, during a cycle time of the power source, holding a representative signal in response to an attribute of the power source;

wherein the representative signal substantially determines the target value.

2. The LED controller of claim 1, wherein the representative signal represents the peak voltage of the power source.

3. The LED controller of claim 1, further comprising a refreshing circuit for refreshing the representative signal when a voltage of the power source is about at a valley.

4. The LED controller of claim 3, wherein the representative signal is refreshed when a most upstream LED group is turned OFF.

5. The LED controller of claim 1, wherein the line waveform sensor has a capacitor for holding the representative signal.

6. The LED controller of claim 1, wherein when the attribute increases the driving current decreases.

7. The LED controller of claim 6, wherein the target value is about a constant when the attribute is below a predetermined threshold, and decreases when the attribute exceeds the predetermined threshold.

8. The LED controller of claim 1, wherein the LED controller is in an integrated circuit with a constant-power sense pin through which the line waveform sensor is direct or indirectly coupled to the power source.

9. The LED controller of claim 1, wherein the management center senses the current through each path switch to control the path switches.

10. A LED control method suitable for controlling a string of LEDs divided into LED groups electrically connected in series between a power source and a ground, the LED control method comprising:

providing path switches capable of separately coupling the LED groups to the ground;

controlling the path switches to make a driving current passing at least one of the LED groups and substantially approaching a target value;

holding a representative signal during a cycle time of the power source, wherein the representative signal is in response to an attribute of the power source and determines the target value; and decreasing the target value when the attribute of the power source increases.

11. The LED control method of claim 10, comprising:

generating a sense current flowing through a sense resistor coupled to the power source; and adjusting the representative signal according to the sense current.

12. The LED control method of claim 10, wherein the representative signal represents the peak voltage of the power source.

13. The LED control method of claim 10, further comprising:

refreshing the representative signal when a voltage of the power source is about at a valley.

14. The LED control method of claim 10, further comprising:

refreshing the representative signal when a most upstream LED group is turned OFF.

15. The LED control method of claim 10, wherein the representative signal is held over a capacitor.

16. A LED lighting system, comprising:

a string of LEDs, divided into LED groups electrically connected in series between a power source and a ground; and a LED controller, comprising:

path switches, each for coupling a corresponding LED group to the ground; and a management center for controlling the path switches, for making an input current from the power source to the string substantially approach a target value;

a line waveform sensor coupled to the power source, for, during a cycle time of the power source, holding a representative signal in response to an attribute of the power source;

wherein the representative signal substantially determines the target value.

17. The LED lighting system of claim 16, further comprising:

a sense resister connected between the line waveform sensor and the power source.

18. The LED lighting system of claim 16, further comprising:

a sense capacitor connected between the line waveform sensor and the power source.

19. The LED lighting system of claim 16, wherein the attribute is the peak voltage of the power source.

20. The LED lighting system of claim 16, wherein the LED controller comprises a refreshing circuit for refreshing the representative signal when a voltage of the power source is about at a valley.

* * * * *